US005735996A

United States Patent [19]

Asghar et al.

[11] Patent Number: 5,735,996

[45] Date of Patent: *Apr. 7, 1998

[54] MULTI-TRANSFER-ROLL HEAT-TRANSFER DECORATOR

[75] Inventors: Syed A. Asghar, Brockton; Joseph F. Callinan, Natick; Paul D. Christo, Duxbury, all of Mass.

[73] Assignee: Avery Dennison Corporation, Pasadena, Calif.

[ * ] Notice: The term of this patent shall not extend beyond the expiration date of Pat. No. 5,709,770.

[21] Appl. No.: 623,409

[22] Filed: Mar. 28, 1996

Related U.S. Application Data

[62] Division of Ser. No. 228,815, Apr. 18, 1994, abandoned, which is a division of Ser. No. 938,929, Aug. 31, 1992, abandoned.

[51] Int. Cl.[6] ..... B65C 9/04

[52] U.S. Cl. ..... 156/448; 156/449; 156/456; 156/542; 156/566; 156/567

[58] Field of Search ..... 156/448, 449, 156/456, 458, 541, 542, 566, 567, 568

[56] References Cited

U.S. PATENT DOCUMENTS 3,064,714 11/1962 Flood ..... 156/542

4,806,197 2/1989 Harvey ..... 156/449

*Primary Examiner*—David A. Simmons
*Assistant Examiner*—Paul M. Rivard
*Attorney, Agent, or Firm*—Kriegsman & Kriegsman

[57] ABSTRACT

A system for applying labels, disposed on a web, to articles, comprising web transfer means for moving the web along a web path, said web path having a label transfer portion, a transfer platen, having a transfer surface, said surface being adjacent the label transfer portion, a plurality of label transfer elements, mounted to the platen and adapted to contact the web and to cause a label to transfer from the web to an article, and a plurality of article presentation means, a plurality of which are adapted to present an article to a the web and a transfer element. A system for applying decorative labels to articles, the system including unwind reel, a wind reel, a web, a web path which transfers the web from the unwind reel to the wind reel, a transfer point on the web path at which a label is transferred from the web to the article. The improvement lies in removing a piece of the web from the web at the transfer point using that piece as a portion of the label and removing it in such a way that the web remains capable of being transferred from the transfer point to the take up reel. The label is formed by perforating a portion of the web as a part of the label and by placing a thermally-actuated adhesive on the label portion of the web but not significantly on the non-label portion of the web.

3 Claims, 27 Drawing Sheets

ROUND BOTTLES $W_V$ = WEB VELOCITY = IN/sec
$L_p$ = LABEL PITCH = IN
$T_C$ = CYCLE TIME = SEC
$B_S$ = BOTTLE SPACING = IN
r = BOTTLE RADIUS = IN
w = ANGULAR VELOCITY = RAD/sec
$C_V$ = CONVEYOR VELOCITY = IN/sec $$T_C = \frac{60}{BPM} = \text{sec}$$

NOTES:
1) FEEDSCREW, INFEED STAR, TURRET AND EXIT STAR ROTATE CONTINUOUSLY.
2) WEB MOVES CONTINUOUSLY BUT IN A DIRECTION OPPOSITE TO THAT OF THE TURRET.

NOTES:
3) SEQUENCE OF EVENTS:
1-2 CONT. FEED INTO STAR
2-3 CONT. FEED INTO TURRET
3-4 CONT. FEED SEATED/INFLATED
4-5 CONT. INDEXED
5-6 DECORATION
6-7 CONT. UNCLAMPED
7-8 CONT. TRANSFERED TO ST
8-9 CONT. TRANSFERED TO CONVEYOR

ROUND BOTTLE DECORATION
USING MODIFIED TD-1000 DECO

DRIVE INPUT TO TURRET/PLATEN WHEEL
STARWHEELS & FEEDSCREWS

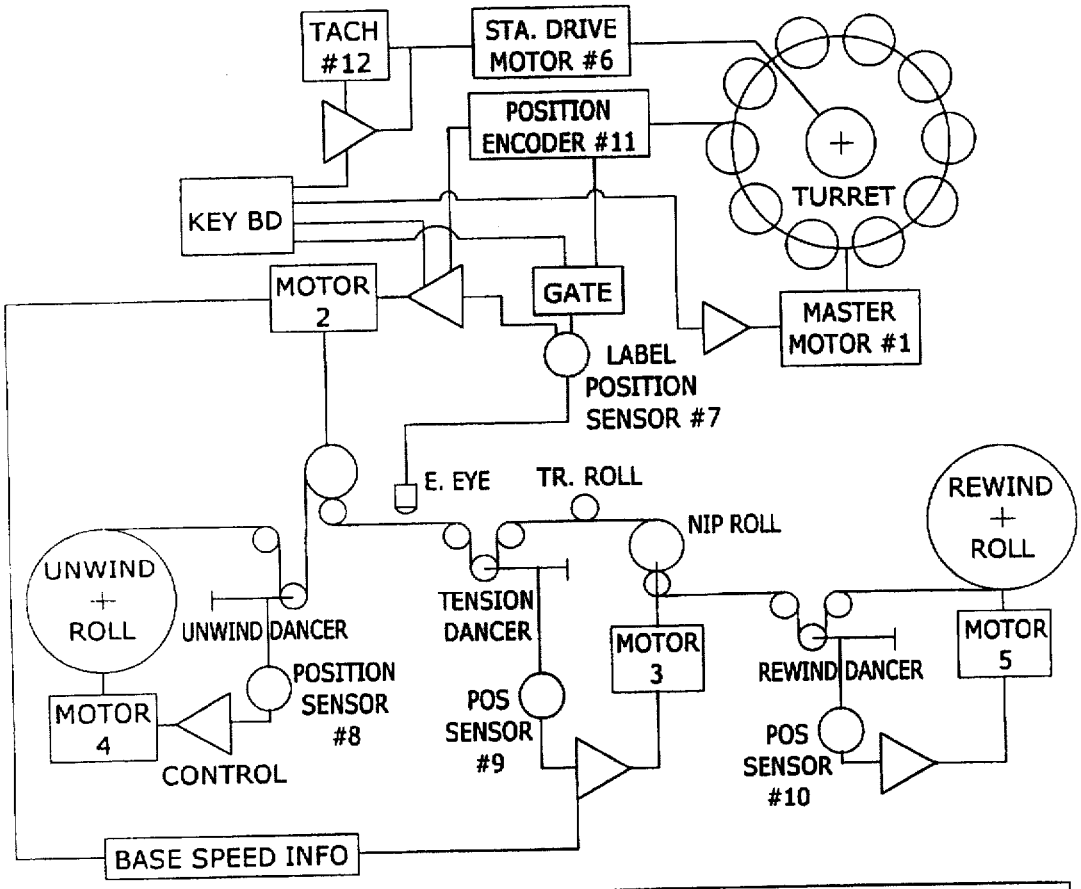

| KEY BOARD ENTRIES |
|---|
| 1. BASE SPD |
| 2. LABEL PITCH / HT |
| 3. GATE MARKERS FOR E. EYE |
| 4. STA. DRIVE SPD INCREASE OR DECREASE |

| ITEM | FUNCTION |
|---|---|
| MOTOR #1 | SETS MASTER SPEED OF MACHINE (TURRET/STAR/FEEDSCREW) |
| MOTOR #2 | SETS BASE WEB SPEED BASED ON LABEL (1 PITCH/CYCLE) |
| MOTOR #3 | FOLLOWS METERING ROLL EXCEPT FOR MINOR CORRECTIONS |
| MOTOR #4 | MAINTAINS CONSTANT DANCER POS. ON U.W. SIDE |
| MOTOR #5 | " " " " " REWIND SIDE |
| MOTOR #6 | SETS CONTAINER DRIVE SPEED |
| POS. SENSOR #7 | REPORTS LABEL POSITION FOR METERING (MOTOR 2) SPD |
| " " #8 | REPORTS DANCER POSITION FOR UNWIND (MOTOR 4) SPD |
| " " #9 | " " " " NIPRL (MOTOR 3) SPD |
| " " #10 | " " " " REWIND (MOTOR 5) SPD |
| " " #11 | REPORTS BASE SPD & POSITION |
| TACH #12 | REPORTS STA. SPD |

FIG. 7

```
6 REM LABELA
19  REM
110 REM
120 REM
130 REM
140         LPRINT "DECORATION ANALYSIS DATA"
150         LPRINT
160         PRINT "ENTER INITIAL LABEL PITCH, HIGHEST LABEL PITCH, LABEL STEP"
170         PRINT "BOTTLE SPACING, BPM, BOTTLE DIAMETER, NO. OF STATIONS"
175         PRINT "SEPARATED BY COMMAS.
180 REM
190         INPUT LP, H, S, BS, BPM, D, N
195         PRINT LP; H; S; BS; BPM; D; N
200         PRINT
210 REM
230               LET TC = 60 / BPM
260               LET CV = BS/TC
262               LET DIAT = N * BS /3.14159
263         LPRINT
264         LPRINT "BPM", "BOTTLE DIA", "SPACING", "CYCLE TIME", "BOTTLE VEL"
265         LPRINT " ", "INCHES", "INCHES", "SEC", "INCHES/SEC"
266         LPRINT
267         LPRINT BPM, D, BS, TC, CV
268         LPRINT
269         LPRINT
270         LPRINT "NO. OF STATIONS", "TURRET DIA"
271         LPRINT " ", " ", "INCHES"
272         LPRINT
273         LPRINT N, ,DIAT
274         LPRINT
275         LPRINT
277         LPRINT "LABEL PITCH", "WEB VEL", "XFER SPEED", "XFER TIME", "TURRET ANGLE"
278         LPRINT "INCHES", "INCHES/SEC", "sec", "degrees"
279         LPRINT
281         FOR L = LP TO H STEP S
282            LET WV = L/TC
283            LET R = D/2
284            LET WR = WV-CV
290            LET W = WR/R
300            LET TD = 1 / W * 6.2832
305            LET C = TD / TC
306            LET A = C * 360 / N
310         LPRINT L, WV, WR, TD, A
312         NEXT L
319         LPRINT
322         LPRINT
330 REM
335 REM
340         END
```

FIG. 8

ROUND BOTTLES $W_V$ = WEB VELOCITY = IN/sec
$L_p$ = LABEL PITCH = IN
$T_C$ = CYCLE TIME = SEC
$B_S$ = BOTTLE SPACING = IN
r = BOTTLE RADIUS = IN
w = ANGULAR VELOCITY = RAD/sec
$C_V$ = CONVEYOR VELOCITY = IN/sec $$T_C = \frac{60}{BPM} = \text{sec}$$

$$W_V = \frac{L_p}{T_c} \qquad \text{OR } (L_p)(BPM)$$

$$C_V = \frac{B_s}{T_c} \qquad \text{OR } (B_s)(BPM)$$

FOR DECORATION ROUND $$W_V = rw - C \qquad \text{OR } \frac{L_p + B_s}{T_c} = rw$$

CONTAINER SURFACE VELOCITY MUST BE EQUAL

TO $W_V + C_V = rw$

FIG. 10

EXAMPLE (#1) 250BPM BOTTLE = 2.50 DIA. 9" PITCH

4" $B_S$ $W_V = 9/60/250 = 37.5$ IN/sec $C_V = 4/60/250 = 16.6667$ IN/sec $T_C = 60/250 = .24$ sec $$W = \frac{9+4}{(.25 + \frac{2.5}{2})} = 43.333 \text{ RAD/sec}$$

CUP REV = 6.8967 REV/sec
413.80 REV/min (SIGN)

CONTAINER SURFACE SPEED = 37.5 + 16.66667
= 54.16667 IN/sec (#2)

60BPM - 2.50 BOTTLE DIA. .2"$L_p$ 4" $B_S$ $W_V = 2/60/60 = 2$ IN/sec $C_V = 4/60/60 = 4$ IN/sec $T_C = 60/60 =/$ sec $$W = \frac{2+4}{(1 + \frac{2.5}{2})} = 4.8 \text{ RAD sec}$$

= 76.39 REV/sec
45.84 REV/min

CONTAINER SURFACE SPEED = 2" / sec + 4 IN/sec
=6 IN/sec

FIG. 11

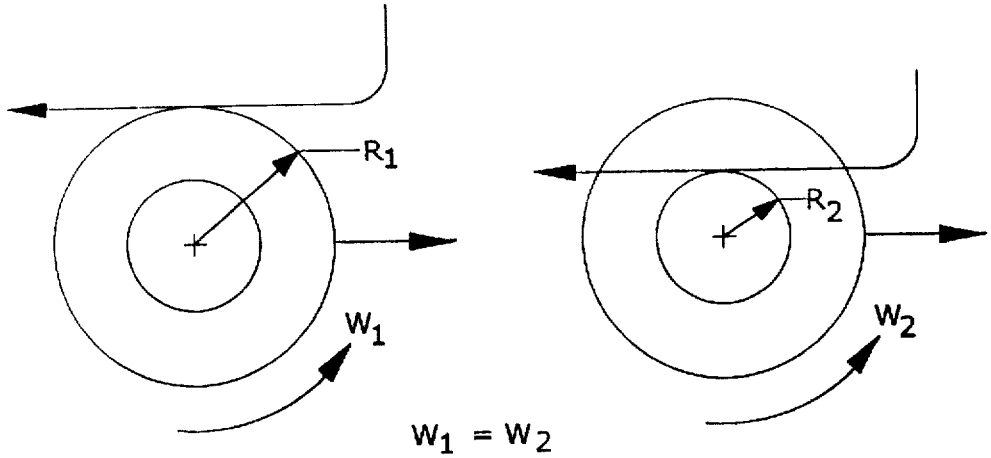

See pg 7

$$\frac{L_{p_1}+B_s}{T_c\, r_1} = \frac{L_{p_2}+B_2}{T_c\, r_2} = W_1 = W_2$$

$$(R_1 - B_s) - R_2 - B_2$$

FIG. 15

IF WE WANT TO DECORATE 2 DIFFERENT DIAMETERS ON THE SAME BOTTLE: THEN

IF $LABEL_1$ $$\frac{L_{p_1}+B_s}{T_c} = r,w \quad \text{OR} \quad \frac{L_{p_1}+B_s}{T_c\, w} = V_1$$

$$\frac{L_{p_1}+B_s}{T_c\, r_1} = W$$

THEN $LABEL_2$ $$\frac{L_{p_2}+B_s}{T_c\, w} = r_2 \quad \text{OR} \quad \frac{L_{p_2}+B_s}{T_c\, r_2} = W$$

IF BECAUSE OF MECHANICAL LIMITATIONS W MUST BE CONSTANT, THEN $$\boxed{W_1 = W_2 / \text{ AND } \quad \frac{L_{p_1}+B_s}{T_c\, r_1} = \frac{L_{p_2}+B_s}{T_c\, r_2} = W}$$

FIG. 16

$W_V$ = LABEL PITCH / CYCLE TIME = IN/sec $= \frac{L_p}{T_c}$ $T_c$ = CYCLE TIME = 60/BPM = SECONDS $C_V$ = CONTAINER LINEAR VELOCITY = B / T = INCH/sec $B_S$ = BOTTLE SPACING = INCHES W = ANGULAR VELOCITY = RAD/sec r = BOTTLE RADIUS $W_V - C_V = wr$ HOLDS TRUE AS LONG AS
$W_V$ IS GREATER THAN $C_V$
&
$B_S$ IS SMALLER THAN $L_p$ $$\frac{L_p}{T_c} - \frac{B_s}{T_c} = wr$$

$$\boxed{\frac{L_p - B_s}{T_c r} = w}$$ = SPEED OF LABEL TRANSFER

LETS LOOK AT SOME VALUES FOR THE FOLLOWING CONDITION 2.50 DIA BOTTLE = 1.25 R.

AT 60 BPM
240 BPM
500 BPM.

FIG. 18

≈ S÷5 2 = 7.68 2π RADIANS

≈ 16" Pd CHECKS RAD/sec IN/sec Time For

| BPM | $B_S$ | $L_p$ | r | $T_c$ | $W_V$ | $C_V$ | w | $W_R$ | 360 BOTTLE |
|---|---|---|---|---|---|---|---|---|---|
| 250 | 4 | 9 | 1.25 | .24 | 37.5 | 16.67 | 16.67 | 20.83 | .377 |
| 250 | 5 | 9 | 1.25 | .24 | 37.5 | 20.83 | 13.33 | 16.67 | .471 |
| 250 | 6 | 9 | 1.25 | .24 | 37.5 | 25 | 10.00 | 12.5 | .628 |

TO 100 @ 56
DECORATE ON
@ 19.00 in/se

.4" sec

DEVELOP CONCEPT FOR 250 BPM - min.

SCALE EVERYTHING UP OR DOWN BY REQUIRED BPM
OVER OR UNDER 250 BPM

FIG. 19

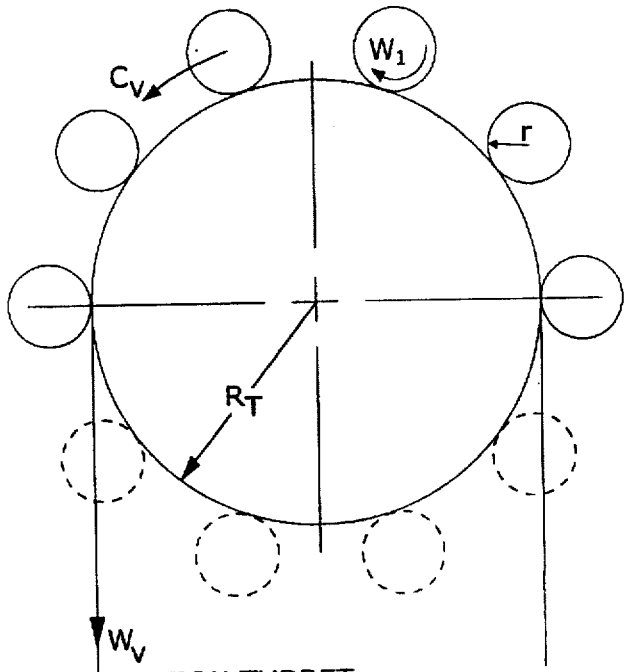

10 STATION TURRET
5" SPACING = 50" CIR. = 15.91549 DIA
$R_T$ = 7.957747

FIG. 20

BASIC $W_V - C_V = W_1 r$ $\quad W_V = \frac{L_p}{T_C}$ $\quad C_V = \frac{5}{T_C} = \frac{B_S}{T_C}$

#1 9" PITCH LABEL 2.50 DIA BOTTLE
250 BPM $T_C$ = .24 sec $W_V = \frac{9}{.24} = 37.5$ IN/sec $\quad C_V = \frac{5}{.24} = 20.83$ IN/sec = DECO SPEED $\quad w_R = 37.5 - 20.83 = 16.67$ IN/sec $\frac{w}{29}$ = Rev/sec $\quad w = 13.333$ RAD/sec
= 2.12 Rev/sec 360° BOTTLE = .47124 sec TURRET = @ 250 BPM = 25 RPM = 1 Rev = 2.4 sec $\frac{360}{2.4} :: \frac{\text{Deco } \measuredangle}{.47124}$ $\quad$ Deco $\measuredangle$ = 70.65°

FIG. 21

CASE 2

13" PITCH C 250BPM
4.00 DIA BOTTLE $W_V$ = 54.167 IN/sec $C_V$ = 20.833 sec $w_r$ = 33.333 IN/ sec w = 16.667 RAD/sec
= 2.6526 Rev/sec
= .37699 Sec/Rev $$\frac{360}{2.4} \quad \frac{\text{Deco} \measuredangle}{.37699} \qquad \text{Deco} \measuredangle = 56.548$$

10 STATION TURRET
5" SPACING = 50" CIR. = 15.91549 DIA
$R_T$ = 7.957747

FOR 250 BPM $T_C = .24$
10 STATION
5" BOTTLE SPACING
RPM = 25
TRev = 2.4 sec

| PITCH IN | $W_V$ IN/sec | BOTTLE R = IN | $w_R$ IN/sec | TIME 360 BOTTLE | TURRET DECO ANGLE | w |
|---|---|---|---|---|---|---|
| 9 | 37.5 | 1.25 | 16.67 | .471 | 70.65 | 13 1/3 |
| 13 | 54+ | 2.0 | 33.33 | .377 | 56.55 | 16 2/3 |

FIG. 24

BASIC (BPM)

Const $W_V - \boxed{C_V} = W_1 r$ $\frac{L_p - B_s}{60/BPM} = w_r$ $W_V = \frac{L_p}{T_C}$ NO Sta.
Deco ∢

$C_V = \frac{5}{T_C} = \frac{B_s}{T_C}$ $\boxed{\#1}$ 9" PITCH LABEL 2.50 DIA BOTTLE
250 BPM $T_C = .24$ sec $W_V = \frac{9}{.24} = 37.5$ IN/sec $C_V = \frac{5}{.24} = 20.83$ IN/sec = DECO SPEED $w_R = \underline{37.5} - 20.83 = 16.67$ IN/sec $\frac{w}{29}$ = Rev/sec w = 13.333 RAD/sec
= 2.12 Rev/sec 360° BOTTLE = .47124 sec/rev FOR 10 STA. TURRET = @ 250 BPM = 25 RPM = 1 Rev = 2.4 sec $\frac{360}{2.4} \;..\; \frac{\text{Deco} \measuredangle}{.47124}$ Deco ∢ = 70.65°

FIG. 25

CASE 2

13" PITCH 4.00 DIA BOTTLE

C 250 BPM $W_V = \frac{\text{@500 BPM}}{13.00 / 15.}$ $W_V$ = 54.167 IN/sec $C_V$ = 20.833 sec $W_r$ = 33.333 IN/sec $W_V$ = 108.333

$C_V$ = 41.666

$W_r$ = 66.6667

0.18 w = 16.667 RAD/sec
= 2.6526 Rev/sec
= .37699 Sec/Rev $\frac{360}{2.4}$ $\frac{\text{Deco} \measuredangle}{.37699}$ Deco ∢ = 56.548

CASE 3 r = 2.0
pitch = 10

$W_V$ = 41.666667

$C_V$ = 20.83333

$W_r$ = 20.833337 w = 10.42 rad/sec $W = \frac{3.315}{2}$ rev/sec t = 0.60359 sec/rev

∝ = 45.23 deg 90.47 deg

CASE 4 r = 2.0
pitch = 15.0

$W_V$ = 62.5

$W_r$ = 41.666667

W = 6.63165 t = 0.03

∝ =

45.23 deg

| pitch | ∝ | |
|---|---|---|
| 10.0 | 90.0 | |
| 13.0 | 56.0 | |
| 5.0 | 45.0 | |

FIG. 26

DEFINITIONS:

$L_p$ = LABEL PITCH

H = HIGHEST PITCH s = PITCH STEP $W_V$ = WEB VELOCITY $B_S$ = BOTTLE SPACING $C_V$ = CONTAINER VELOCITY $T_C$ = CYCLE TIME

BPM = BPM r = BOTTLE RADIUS

D = BOTTLE DIAMETER wr w $T_C$ = DECORATING TIME

FIG. 27

Top view of a conceptual web with a printed and perforated Graphic

Side view of lab sample transferred to a pre-flamed polypropylene deodorant stick

VARIATIONS OF WEB ROLL (1) PERFORATION DONE ON THE DECORATOR (3) ADHESIVE APPLIED AND LABEL AREA PERFORATED ON THE DECORATOR
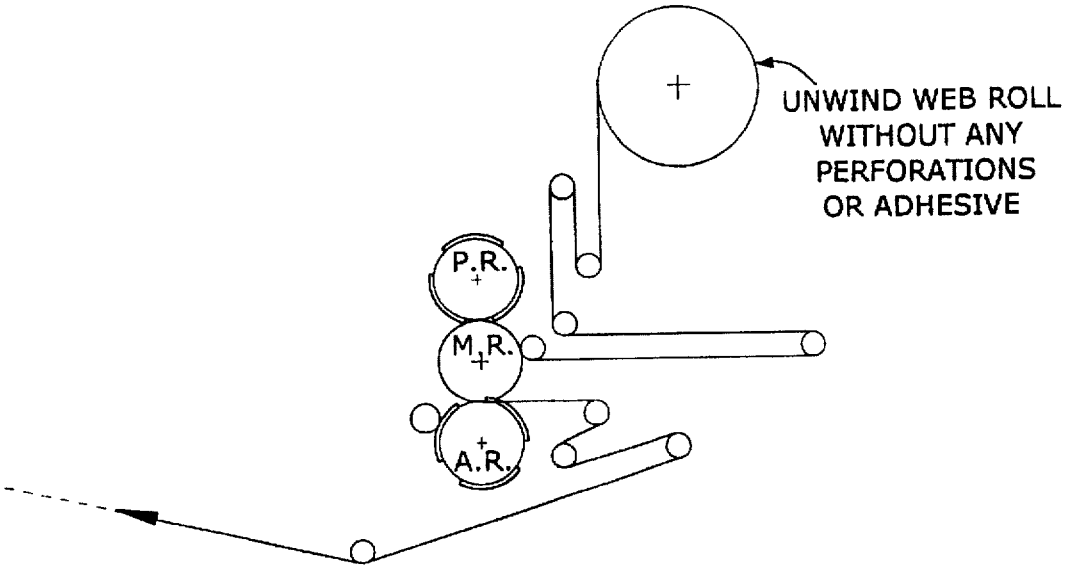
FIG. 42
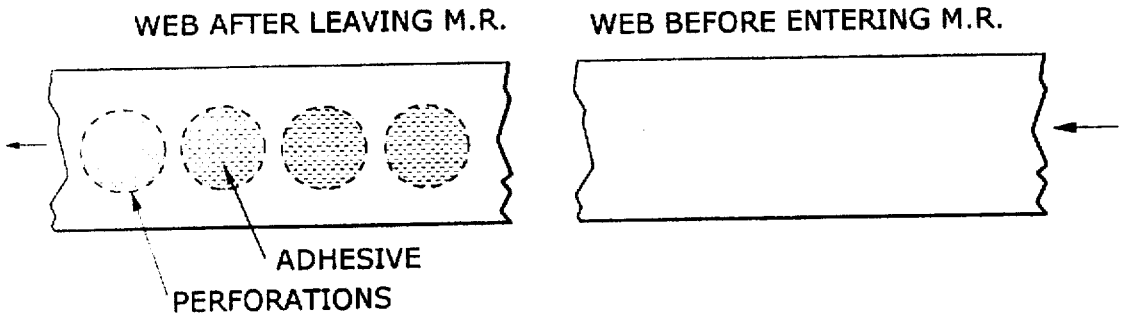
FIG. 44
FIG. 43

MULTI-TRANSFER-ROLL HEAT-TRANSFER DECORATOR

This is a divisional of application Ser. No. 08/228,815 filed on Apr. 18, 1994, now abandoned, which is a division of Ser. No. 07/938,929 filed on Aug. 31, 1992, now abandoned.

FIELD OF THE INVENTION

A system for transferring heat-activated adhesive labels from a moving web to articles which require decoration.

BACKGROUND OF THE INVENTION

The technology for transferring heat-activated adhesive labels from a moving web to articles which require decoration is well developed and is the subject of numerous patents and other literature. Some of those patents, the contents of which are incorporated here by reference are:

| | |
|---|---|
| C. A. Flood | 2,981,432 |
| C. A. Flood | 3,111,446 |
| C. A. Flood | 3,139,368 |
| C. A. Flood | 3,208,897 |
| C. A. Flood | 3,313,667 |
| Bains et al. | 3,483,063 |
| Spokowski et al. | 3,524,786 |
| Wochner | 3,861,986 |
| Hoffmann | 4,242,167 |
| Bauer | 4,300,974 |
| Geurtsen et al. | 4,452,659 |
| Asghar et al. | 4,735,664 |
| Parker | 4,927,709 |

In most systems, the equipment is designed so that web passes across a transfer roll and a rotatable turret stops an article in front of the transfer roll and rotates the article against the transfer roll so that the web speed and surface velocity of the article are substantially equal. Because the web carries adhesively active labels, the label is essentially applied to the article as they roll against one another.

Although this technology is highly developed and has been the subject of significant effort over many years, the equipment has reached the level of sophistication where further increases in the speed at which the equipment can decorate articles has ceased to be economically practical. Attempts to operate these single-transfer-point machines at higher decorating speeds have resulted in either unacceptable increases in the cost of the equipment, maintenance difficulties with the equipment, or unacceptably low quality of the results of the decorating operation. These and other difficulties experienced with the prior art devices have been obviated in a novel manner by the present invention.

It is therefore an outstanding object of the present invention to provide an article decorating machine which is capable of operating at substantially higher throughput speeds than is practical in existing machinery.

It is a further object of the present invention to provide decorating equipment which is capable of handling a very large variety of article shapes with minimum alteration of the equipment and with minimum down-time of the equipment during change over from one shape to another.

With these and other objects in view, as will be apparent to those skilled in the art, the invention resides in the combination of parts set forth in the specification and covered by the claims appended hereto.

SUMMARY OF THE INVENTION

This invention involves the improvement of article decorating equipment by exchanging the conventional single-transfer point apparatus for a series of transfer points which by acting serially, simplify the motions of the equipment and reduce the amount of non-decoration time in the cycling of the equipment.

The concept is expressed in three embodiments, depending on the shape of the article to be decorated. The three embodiments are: 1. cylindrical or round; 2. oval; and, 3. flat-sided or flat. In each of the three cases, embodiments are provided for either vertically straight-sided articles or tapered articles.

The concept of this invention is that the single transfer roll of a heat transfer web decorator is replaced by a plurality of transfer rolls, a plurality of which are being used at any given time to participate in the decoration process. In that way, there is essentially more than one article being decorated at any given moment. This essentially minimizes or eliminates that portion of the cycle in which no decoration is occurring.

In the preferred design concept of this invention, the multiple transfer rolls would be arranged around the outer radius of a transfer cylinder. The web carrying the labels would be drawn around a substantial portion of the circumference of the transfer cylinder and the objects to be decorated would be transported along a path which is intermittently or continuously peripheral to a substantial portion of the transfer cylinder. In one approach, the transfer cylinder, with transfer rolls, rotates, and the tooling translates the article along with a roll. In another approach, the transfer rolls do not translate and the tooling moves the article surface past the stationary transfer point.

BRIEF DESCRIPTION OF THE DRAWINGS

The character of the invention, however, may best be understood by reference to one of its structural forms, as illustrated by the accompanying drawings, in which:

FIG. 7 is a schematic representation of the control and timing system for a decorating machine embodying the principles of the present invention, FIG. 8 is a computer program in BASIC language, for determining parameters used in the present invention, FIG. 9 sets out the theory and calculations used in the present invention, FIG. 10** sets out the theory and calculations used in the present invention, FIG. 11 sets out the theory and calculations used in the present invention, FIG. 42 is a schematic representation of a decorating machine embodying the principles of the present invention, FIG. 43 is a schematic representation of a web embodying the principles of the present invention, FIG. 44 is a schematic representation of a web embodying the principles of the present invention,

DESCRIPTION OF THE PREFERRED EMBODIMENTS

Figure 1:
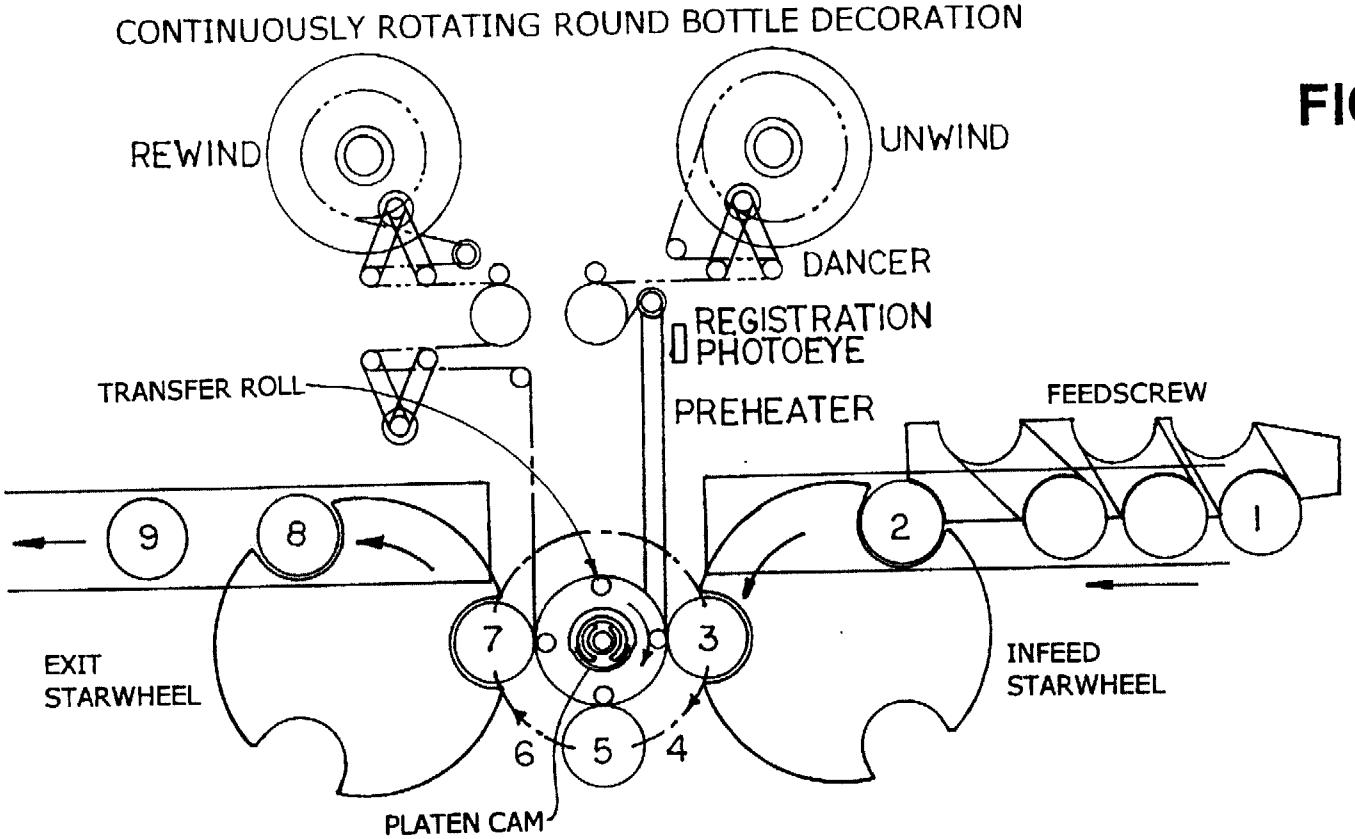
FIG. 1 is a schematic representation of a decorating machine for labeling round containers, embodying the principles of the present invention.

There are six distinct embodiments of the present invention. The first embodiment which is set out in FIG. 1 is designed to decorate straight-sided round objects (cylinders), using heat transfer labels.

Figure 2:
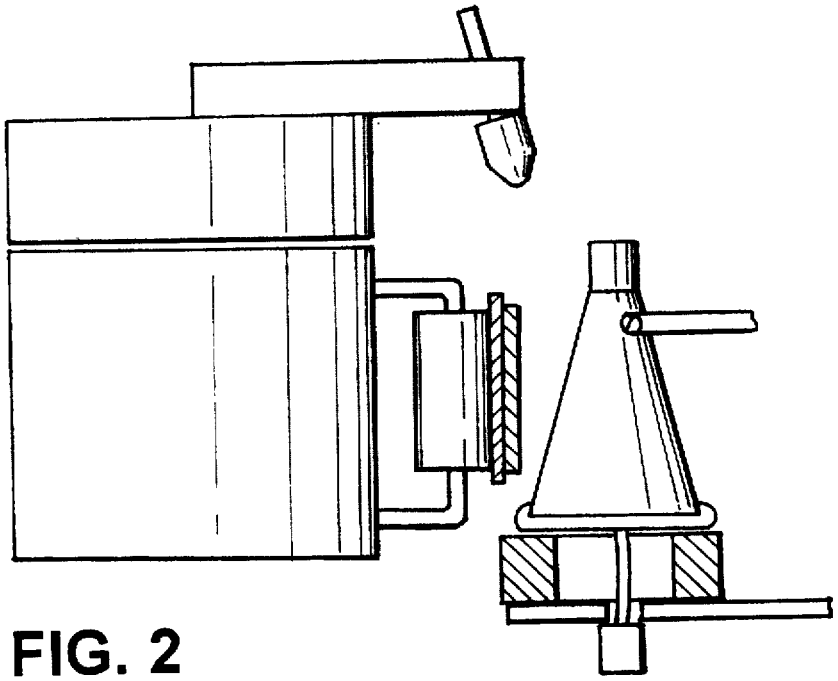
FIG. 2 is a schematic representation of an article tipping system, prior to tipping, for a decorating machine and embodying the principles of the present invention.
Figure 3:
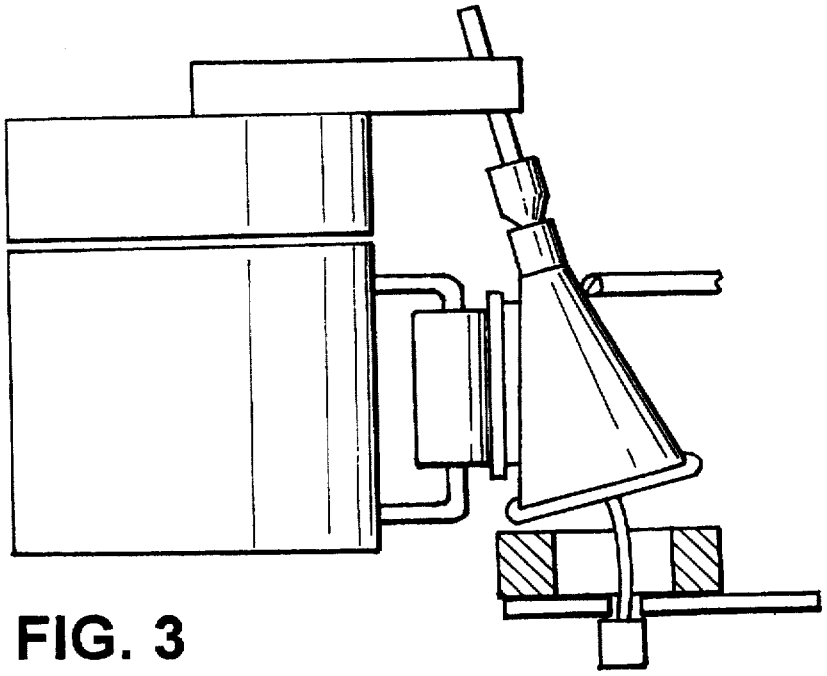
FIG. 3 is a schematic representation of an article tipping system, after to tipping, for a decorating machine and embodying the principles of the present invention.

The second embodiment shown in FIGS. 2–3 is designed to decorate tapered round objects (circular conic shapes) using heat-transfer labels.

Figure 4:
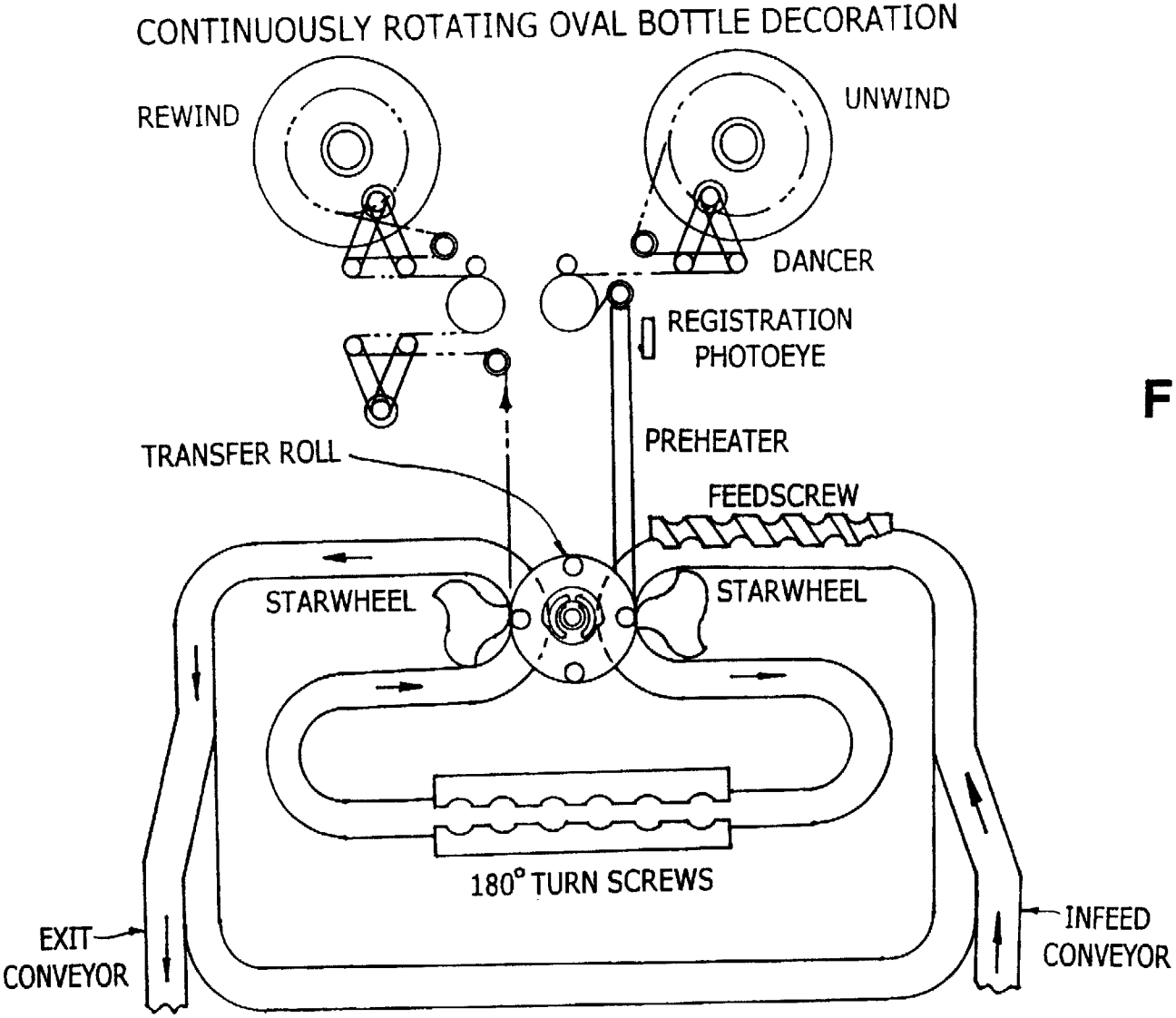
FIG. 4 is a schematic representation of a decorating machine for labeling oval articles, embodying the principles of the present invention.

A third type, as shown in FIG. 4 is designed to decorate straight-sided objects having oval cross-sections using heat-transfer labels.

A fourth embodiment of the invention is designed to decorate tapered oval objects (with changing oval cross-sections) using the heat-transfer labels.

Figure 5:
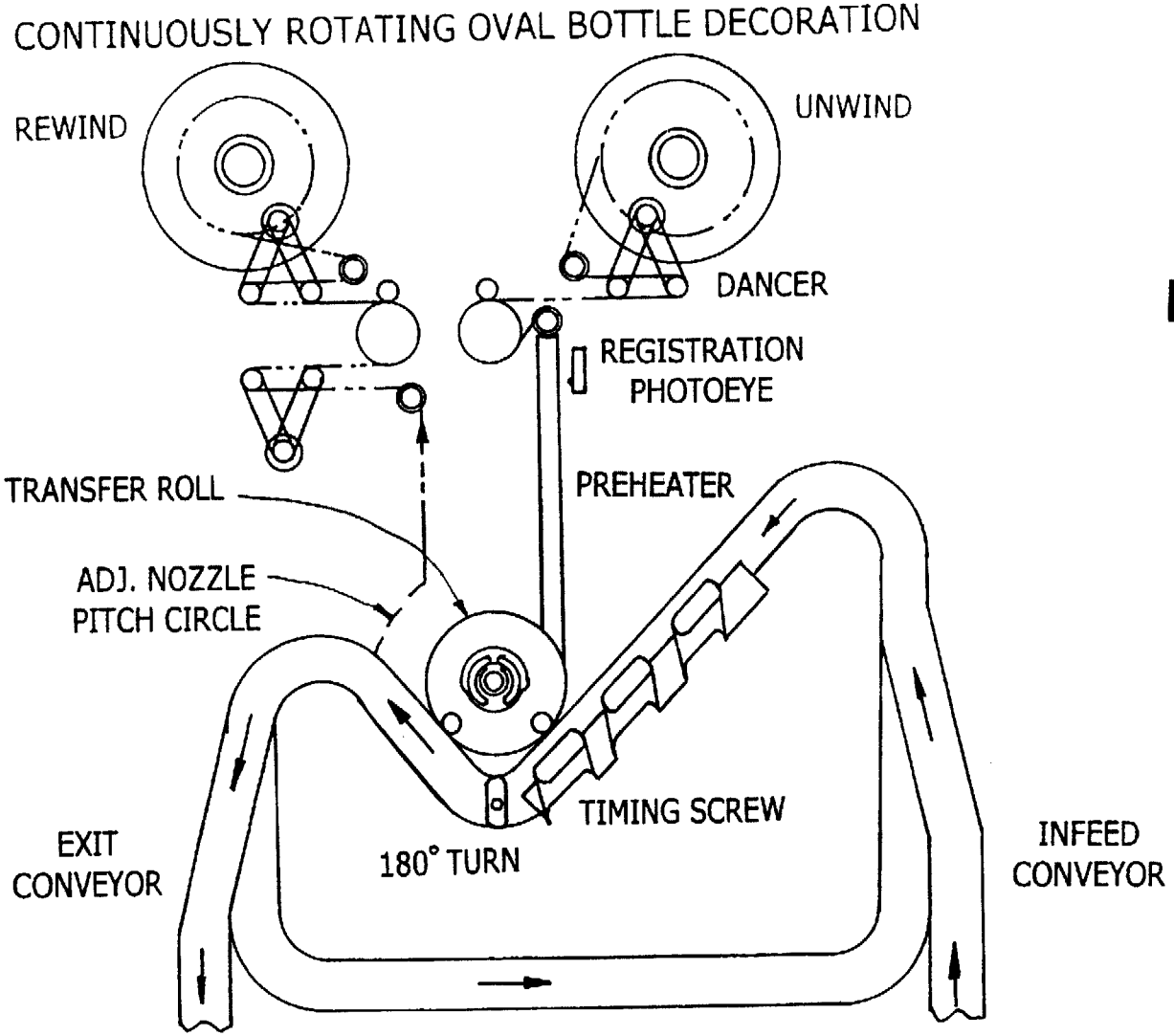
FIG. 5 is a schematic representation of a decorating machine for labeling flat-sided articles, embodying the principles of the present invention, FIG. **6*a* is a schematic representation of a modular adapter for existing designs of a decorating machine for labeling round containers embodying the principles of the present invention.

A fifth embodiment of the invention shown in FIG. 5 is designed to decorate objects having planar sides using heat-transfer labels.

A sixth embodiment of the invention involves designs to decorate objects with planar sides which are tapered so that the thickness of the object varies.

Each of the six embodiments of the invention would be designed to provide inflation air pressure for the object to be decorated if that pressure was required to provide a sufficiently rigid surface to decorate. These embodiments of the invention offer distinct advantages of increased decorating speed and decorating efficiencies.

ROUND OBJECT DECORATION (Straight-sided and tapered objects with round horizontal cross-sections)

The method of decorating round objects as conceived in this invention and described below would reduce the label transfer speeds considerably and increase the decorating time to more than double that available in the conventional method for a given throughput. The ability of the transfer roll to move along with the object being decorated gives the added advantage of decorating tapered round objects.

CONCEPT DESCRIPTION FOR ROUND ARTICLES (FIG. 1)

The label web is wrapped around a heated platen wheel which houses multiple transfer rollers and moves at a pre-programmed speed and direction by means of a separate drive source. Both platen wheel and the turret rotate at the same speed driven by a common drive source. There are as many transfer rollers in the platen wheel as there are stations on the turret. Each transfer roller can individually be cammed out by means of a fixed cam (or other means) to press against the round object being decorated at the required time each transfer roller is located directly at each station.

The object holding stations consist of cups and nozzles with the ability to turn the object at the required speed which is imputed by a separate source. The nozzles are adjustable both radially and axially and also have the capability to inflate the object being decorated.

The cups are adjustable radially only. Where required, the cups will also have the capability to rotate and register the object being decorated with respect to any known mark such as a detent on the bottom of a round bottle where the seam may be required to be avoided for decorating purposes.

The label web is wrapped around the platen wheel for approximately 180 degrees and travels in the same direction as the cup is travelling. During the actual decoration process, the cup, and object held in it, rotates as well, so that the surface speed of the object matches the web speed thereby affecting smooth label transfer.

TAPERED ROUNDS (FIGS. 2 and 3)

When decorating tapered round objects the same concept as for the straight rounds is used except that it is necessary to tip the object so as to make contact with the transfer rollers. In order to accomplish this, the cup and nozzle assembly will be made adjustable at the required angle along with the inflating and drive assemblies. To further simplify the coupling of the cup drive to the cups, a flexible shaft connection will be utilized to adapt to any angular orientation.

In the preferred approach, the infeed starwheel will accept the round objects in a vertical orientation and, with the aid of camming rails, the object will be tipped to the required angular position as it is moved into the turret. Similarly, after decoration, the exit starwheel will accept tipped objects and will cam them back to the vertical position before exiting onto the conveyor.

OVAL DECORATION (FIG. 4)

The method of decorating oval objects (straight sided and tapered) as conceived in this invention would increase decorating speeds, throughput, and efficiencies and also provide the ability to decorate two sides of oval objects using an adjustable radius turret concept with a minimum of change parts.

As in the case of rounds, the label web is wrapped around the platen wheel but in the case of ovals, the platen wheel is stationary and only the web and the object being decorated move in the same direction at matching speeds. The transfer rollers, however, have the ability to be cammed out to cause the label on the web to make contact with the object being decorated at the proper time. The central cam, in this case, rotates.

The oval objects are fed into the first turret starwheel (continuously rotating) from a feedscrew (also continuously rotating). The turret has nozzle assemblies at the top with air inflating capabilities. There are as many nozzles as there are pockets in the starwheel. At the proper angle, the nozzle engages and holds the object down and also inflates it, if inflation is required. The object then sweeps by the first transfer roll where the face label is applied. Face and reverse labels are printed alternately on the label web.

The face decorated object is then released by the nozzle and leaves the starwheel and travels on the conveyor through a pair of screw-turners which turn the object 180 degrees. It then continues down the conveyor and is fed into a second turret starwheel where it is clamped and inflated (if required) before being decorated with the reverse label at the 2nd transfer roller station.

The key to achieving a universal change part turret center or axis involves a unique arrangement of the starwheel turrets and conveyors which, in turn, makes the turret radius (and axis) radially adjustable to match the oval panel radius of the object being decorated. The radius adjustment is achieved by making the axes of the starwheels radially adjustable with respect to the transfer cylinder, and by routing the conveyor in a double 's' pattern which provides a self-compensating assembly within the conveyor system, so that shortening of one leg, equally lengthens another leg to keep the conveyor length constant.

Also by adjusting the turret radius to match the panel radius, the web speed does not normally have to be modulated as decoration occurs, which otherwise, would be needed when the panel radius is different from the turret radius. The decoration of the tapered ovals would use the same concept as the straight ovals and the tipping concept described for tapered rounds.

FLAT OBJECT DECORATION (FIG. 5)

The method of decorating flat panel objects as conceived in this invention would increase decorating speeds, throughput, and efficiencies and also provide the ability to decorate two sides of flat objects using a conveyor, timing screw and an adjustable nozzle assembly which also has the ability to turn the object 180 degrees between decorations.

As in the case of rounds and ovals the label is wrapped around the platen wheel and as in the case of ovals, the platen wheel is stationary and only the web and objects being decorated move in the same direction at matching speeds.

Also as in the case of ovals and rounds the transfer rollers have the ability to be cammed out to make contact with the flat object being decorated at the proper time. The cam in this case rotates.

Additionally, there is a nozzle arm assembly which rotates about the platen wheel center and has a finite number of nozzle assemblies mounted to it. The nozzle arm assembly rotates in the same direction as the web. Each nozzle has the ability to move down to clamp the flat object and inflate it if required. Furthermore, each of the nozzle arms have the ability to allow the nozzle and cup assemblies to be cammed in and out radially while in motion thus effecting a straight line motion during label transfer at the two decorating stations.

Also, the nozzle assembly has the ability to rotate the object 180 degrees after the first label has been applied and before the second label goes on.

A contoured path conveyor is utilized to route the objects into the timing screw.

As in the case of ovals, the key to achieving a universal flat object decoration capability is the straight line motion of the flat object in front of the stationary decorating stations. This eliminates the need for modulating the web speed during decoration.

The decoration of tapered, flat-paneled articles and the tipping concept described for the tapered rounds.

Figure 6A:
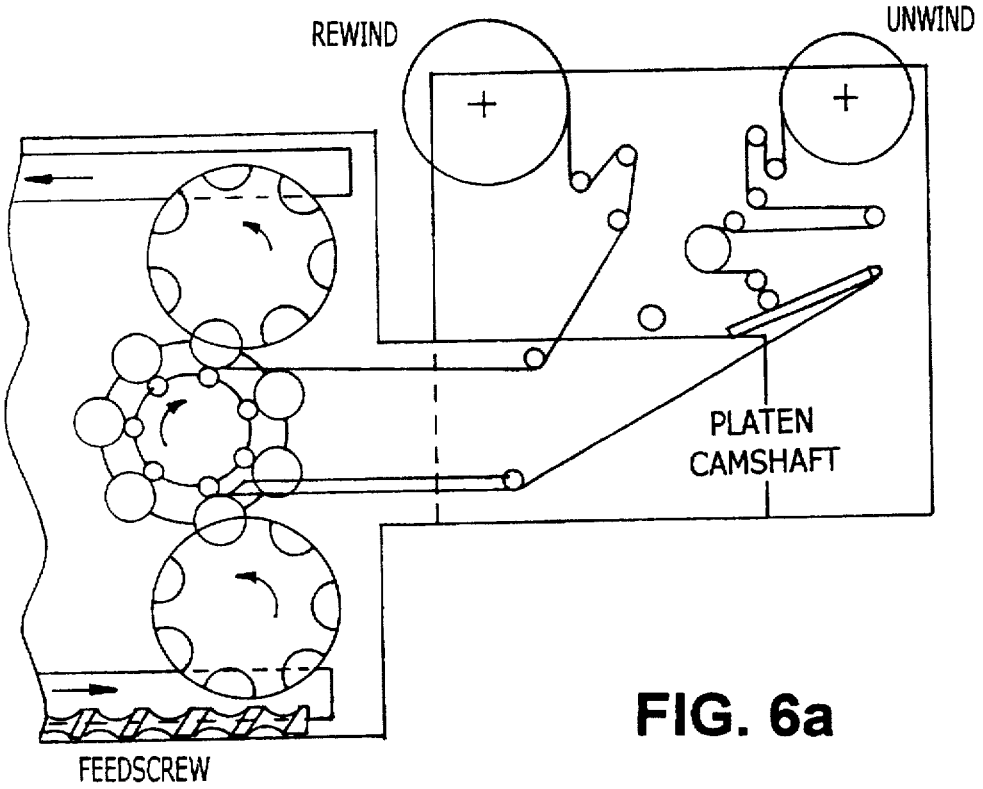
FIG. 6*b* is a schematic representation of the drive system for the decorating machine shown in FIG. 6*a*.
Figure 6B:
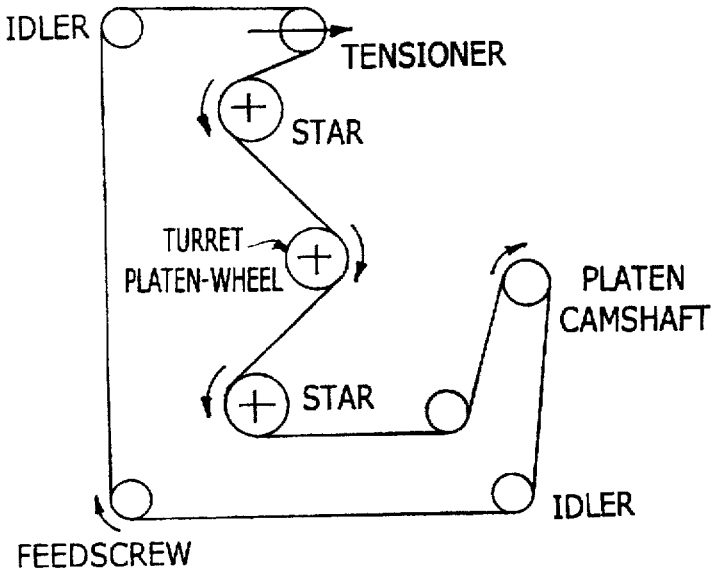
Figure 9:
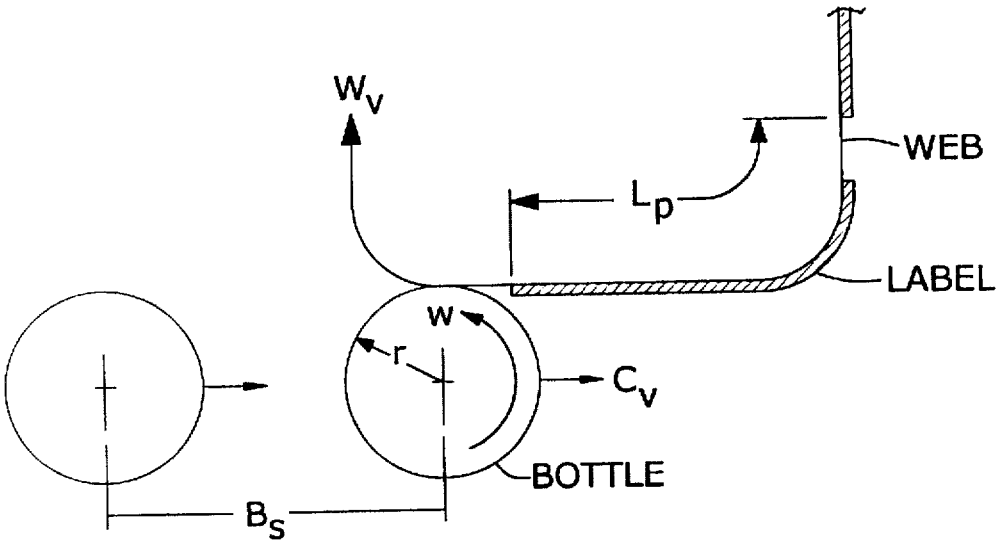
Figure 12:
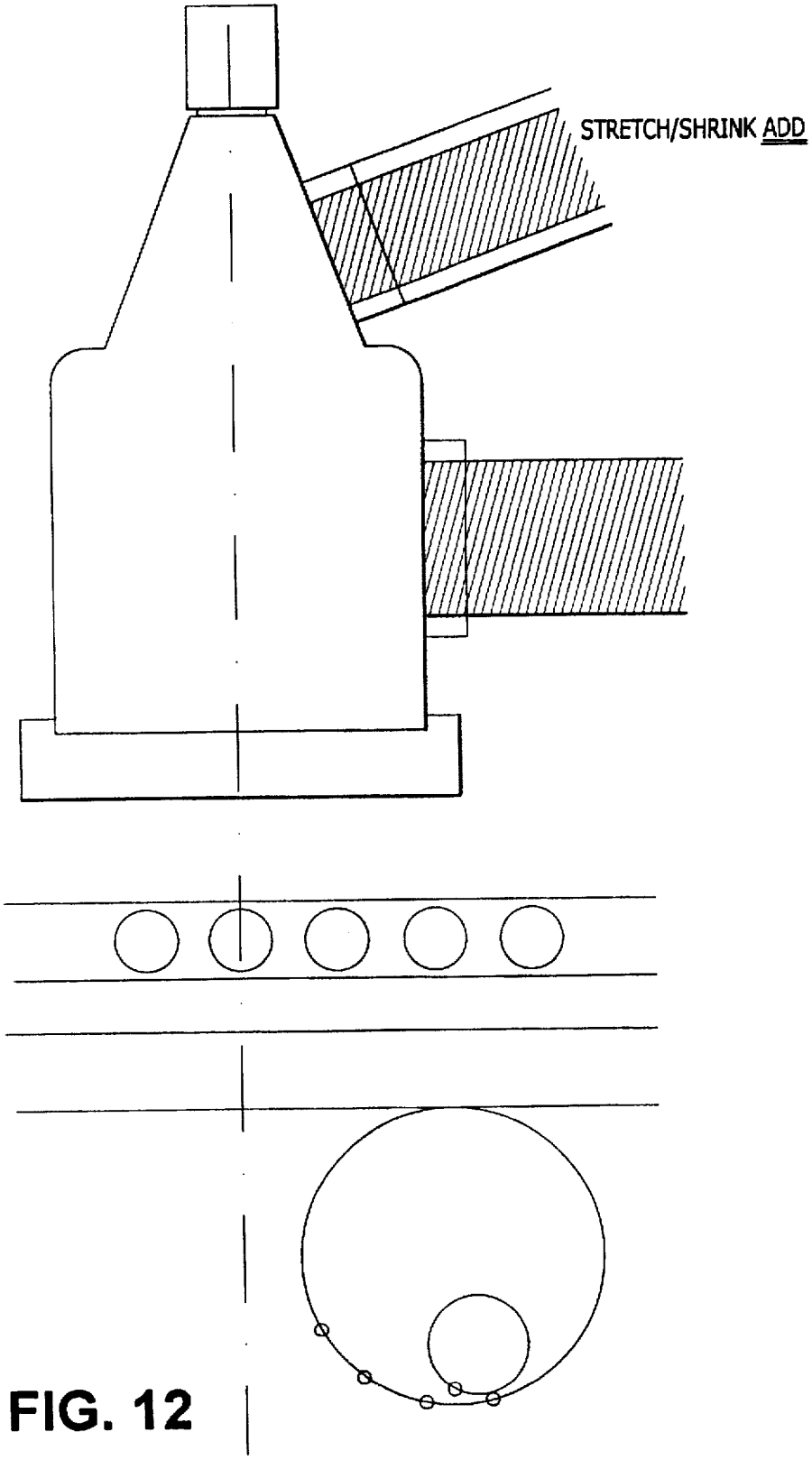
FIG. 12 is a schematic representation of a decorating machine embodying the principles of the present invention.
Figure 13:
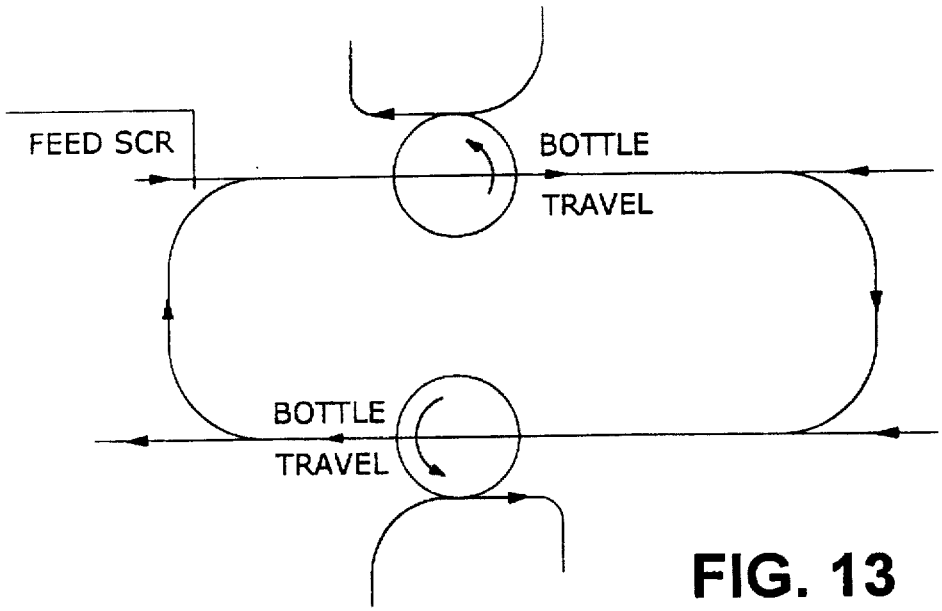
FIG. 13 is a schematic representation of a decorating machine embodying the principles of the present invention.
Figure 14:
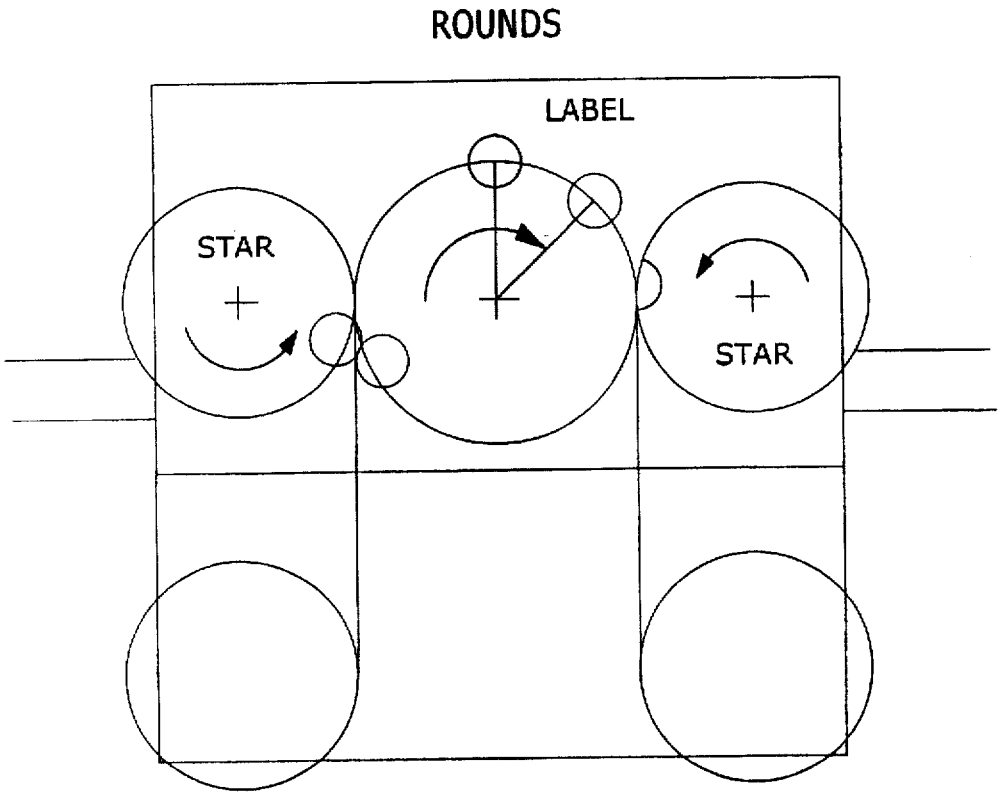
FIG. 14 is a schematic representation of a decorating machine embodying the principles of the present invention, FIG. 15 sets out the theory and calculations used in the present invention, FIG. 16 sets out the theory and calculations used in the present invention, FIG. 17 sets out the theory and calculations used in the present invention, FIG. 18 sets out the theory and calculations used in the present invention, FIG. 19 sets out the theory and calculations used in the present invention, FIG. 20 sets out the theory and calculations used in the present invention, FIG. 21 sets out the theory and calculations used in the present invention, FIG. 22 sets out the theory and calculations used in the present invention, FIG. 23 sets out the theory and calculations used in the present invention, FIG. 24 sets out the theory and calculations used in the present invention, FIG. 25 sets out the theory and calculations used in the present invention, FIG. 26 sets out the theory and calculations used in the present invention, FIG. 27 sets out the theory and calculations used in the present invention.
Figure 17:
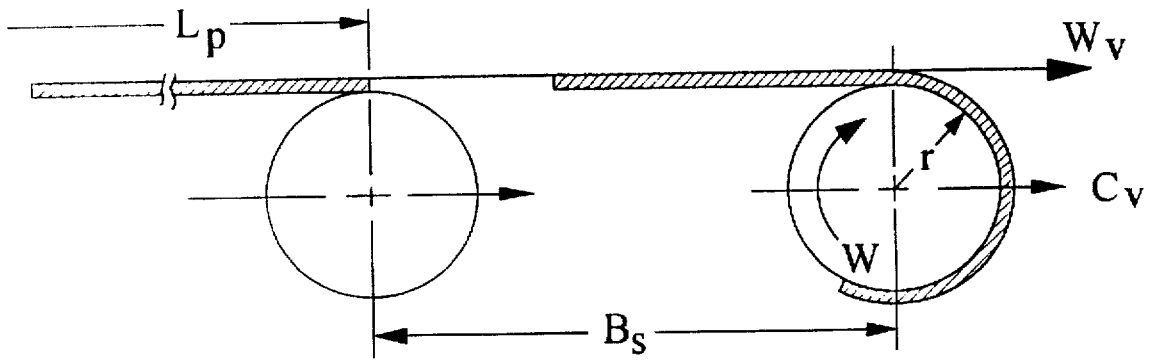
Figures 22, 23:
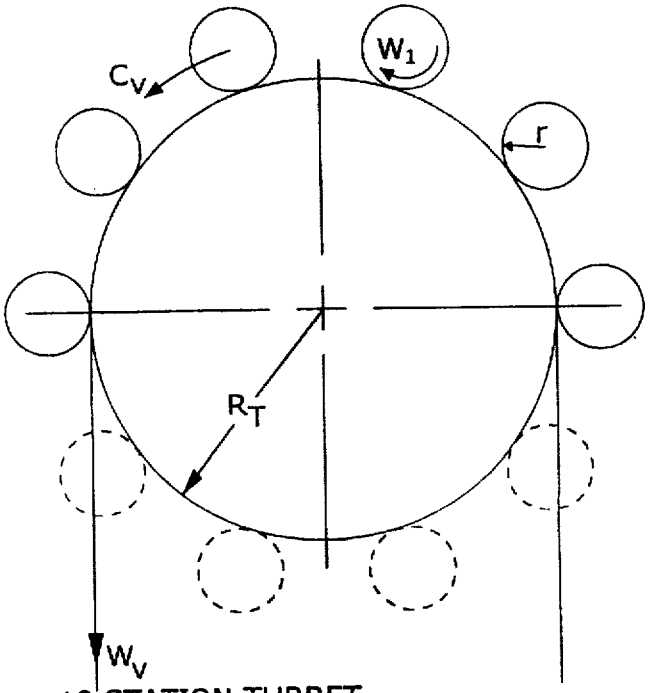
Figure 28:
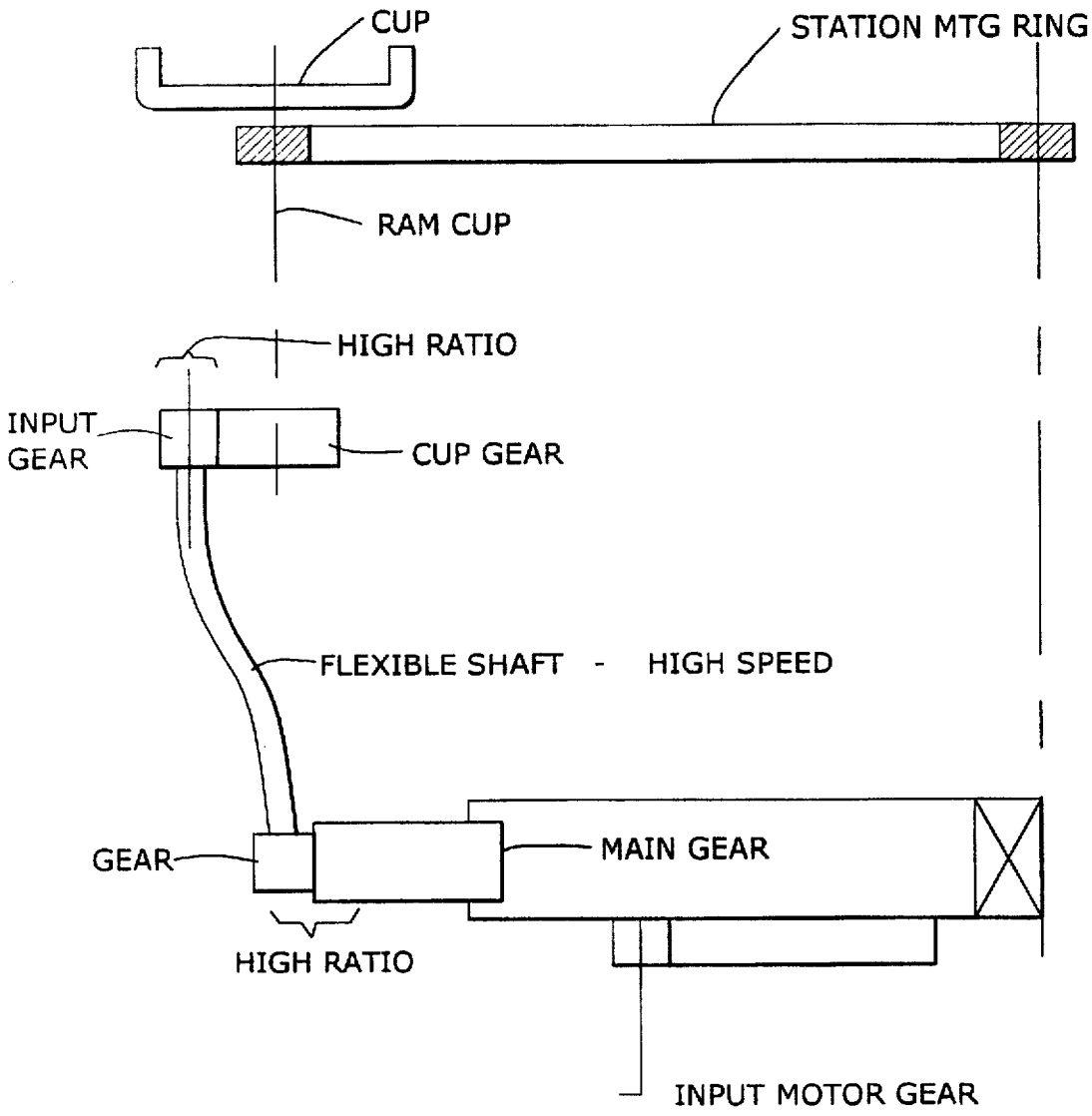
FIG. 28 is a schematic representation of a drive train including a flexible cup coupling for a decorating machine embodying the principles of the present invention.
Figure 29:
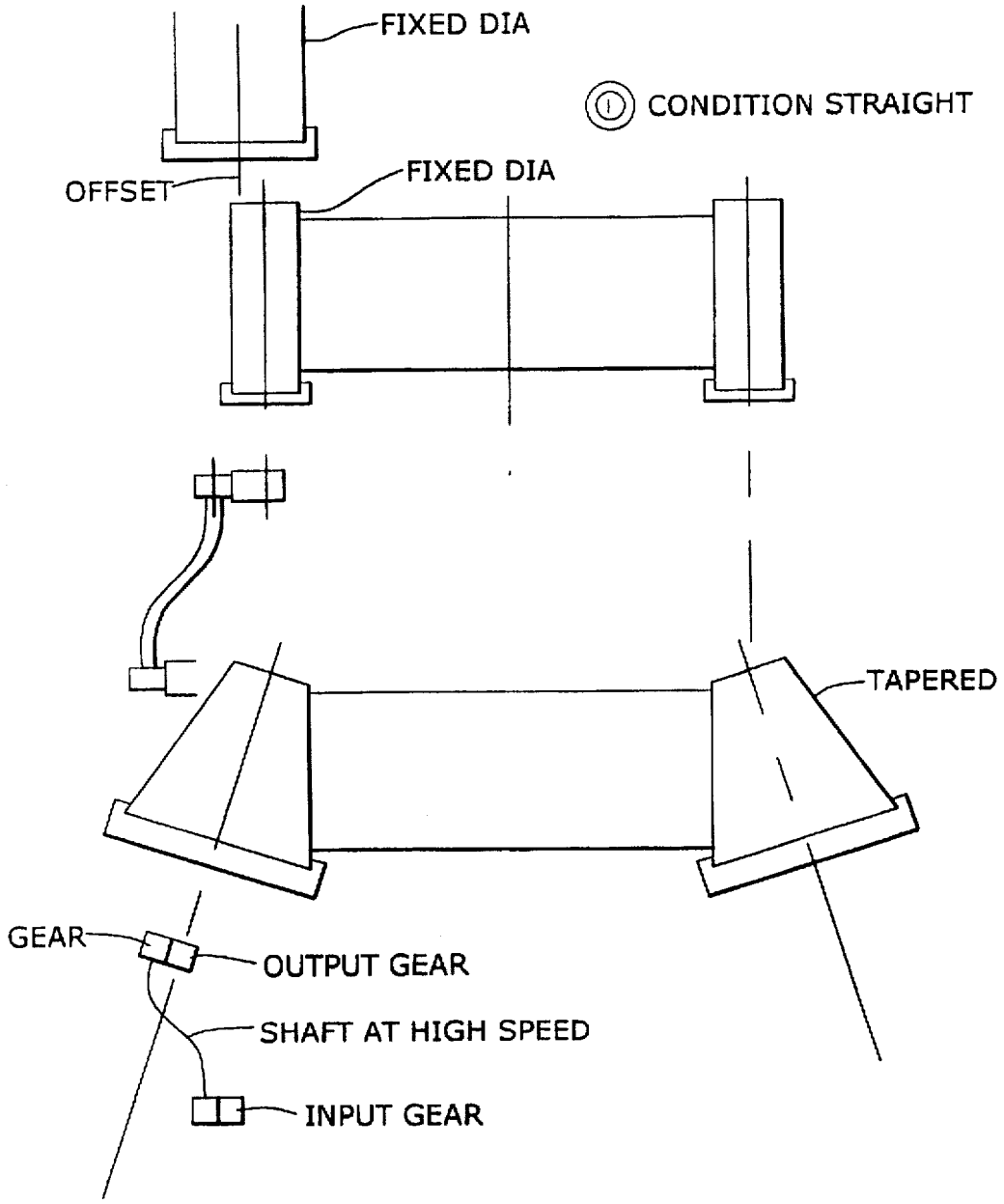
FIG. 29 is a schematic representation of a drive train including a flexible cup coupling for a decorating machine embodying the principles of the present invention.

FIG. 6 shows a concept by which the embodiments of the present invention could to added, in a modular manner, to existing decorating equipment.

FIG. 7 shows the control plan for an embodiment of the present invention.

FIGS. 8–29, present timing theory and calculations for operation the various embodiments of the present invention to achieve its benefits.

The following new features are also conceived for this invention:

1. Method of Camming Web Away From the Hot Platen Wheel During Stops

In the case where the adhesive used to attach the labels in this invention would be heat-activated, the prefered embodiment of the invention would heat the label by heating the transfer cylinder and allowing the contact of the web and cylander to heat through to the label, while the adjacent transfer roller is in its retracted position. For the cylinder to be hot enough to heat the moving web sufficiently, it would normally be too hot to allow stationary and extented contact between the web and the cylinder, without damage to the web. This problem would occur if the machine were stopped for any reason while the web is in place. To avoid damage to the web, provision is made to simultaneously expell all of the transfer rolls, or other lift-off elements, radially outward from the cylinder to hold the web entirely off the cylinder during machine stopages.

2. Method of Utilizing a Low Voltage/High Amperage DC Current Input to Heat the Platen Wheel As described above, the cylinder would need to be heated in a way which is compatable with the machine situation. Peferably, the heat would be provided by low voltage, direct current in order to avoid the sparking which is promoted when high voltage is present.

3. Method of Measuring and Controlling the Platen Wheel Temperature Using Contactless Infrared Sensors The temperature of the cylinder described above should be controlled fairly closely in order to optimize performance of the equipment. Because it is the temperature of the outer surface of the cylinder that is critical, the preferred control sensor would be a radiation sensor, such as an infrared sensor, which views, but does not contact, that surface, to monitor the temperature of the surface.

4. Method of In-turret Flaming

POP-OUT LABEL SYSTEM

Various methods of transferring the pre-printed labels onto containers or other articles are embodied in this specification. The discussion below concerns a particular type of label which will be referred to as a pop-out label. It can be applied in the equipment described above or conventional equipment if either is modified as discussed below.

The pop-out label consists of a pre-printed clear and very thin plastic web with an adhesive layer as its outer-most coating. The adhesive layer is made up of a heat-sensitive lacquer. Upon application, this lacquer becomes the innermost layer which adheres to the article being decorated and the clear plastic layer becomes the outside surface with the ink sandwiched in between. Having the plastic surface outside and the inks in between has many advantages, such as scratch, scuff, and product resistance, etc. The pattern in which the adhesive lacquer is printed will determine the method by which the label can be applied to the article being decorated. There are essentially three approaches to this type of label.

First, adhesive lacquer can be applied over the entire web surface of the web in roll form. This type of pop-out label may be applied by a conventional roll-feed, cut and glue application machines, such as those made by Al-Fill, Trine, or B & H Machining.

Second, adhesive lacquer can be can be applied over the entire label surface and the labels could be supplied in stack form. This type of pop-out label would require a stack-feed, vacuum drum-type application machine, such as those made by Krones or Koyo.

A third approach involves applying adhesive lacquer over the label area only and providing the web is in roll form with the label area being perforated as well. This type of pop-out label requires a different type of application equipment which is similar to a heat-transfer decorator with modifications. However, by introducing a few variations, this application technique can be made quite unique. These features are:

1. By accomplishing the perforating of the label area of the web on the decorator itself.
2. By accomplishing application of the adhesive lacquer only on the label area and on the decorator itself.
3. Transferring only the perforated label and adhesive from the web to the article by pressing the transfer roller against the back of the label, causing it to pop-out from the web and the stick to the article being decorated and then winding up the remaining web matrix.

Figure 30:
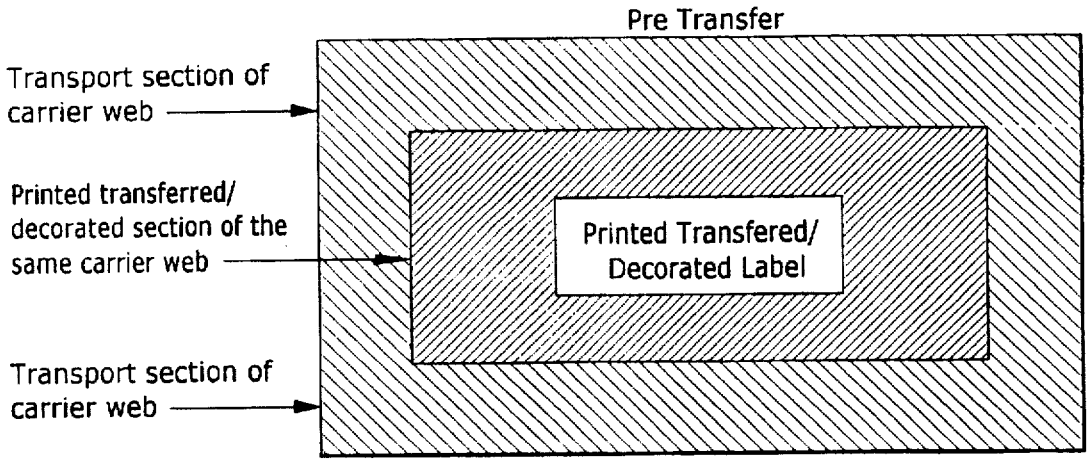
FIG. 30 is a schematic representation of a web embodying the principles of the present invention.
Figure 31:
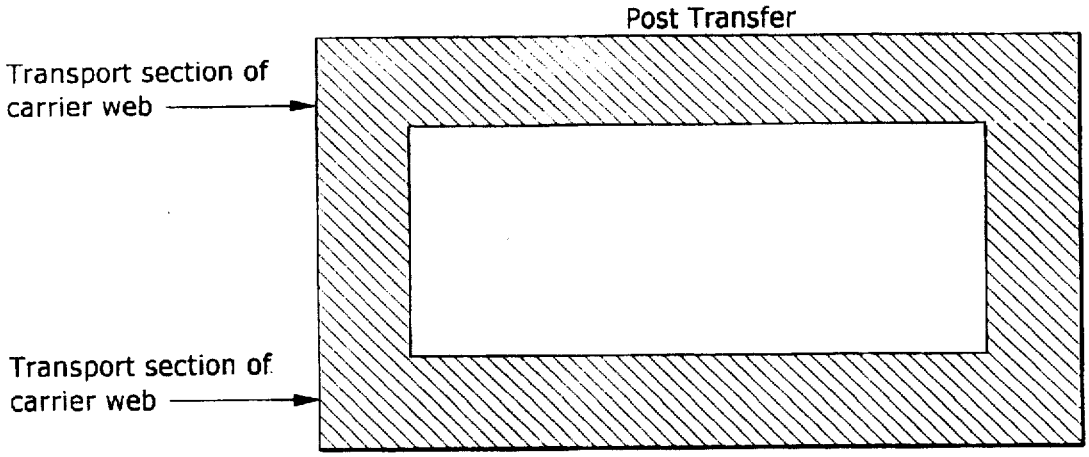
FIG. 31 is a schematic representation of a web embodying the principles of the present invention.
Figure 32:
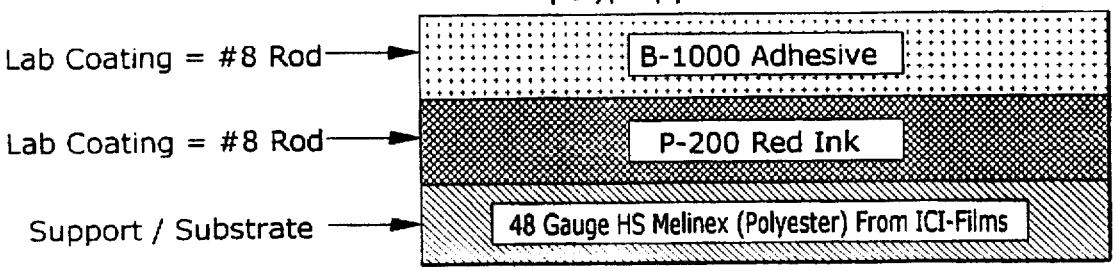
FIG. 32 is a schematic representation of a web embodying the principles of the present invention.

FIGS. 30–32 show the construction of the web and the label popped-out from it.

Figure 33:
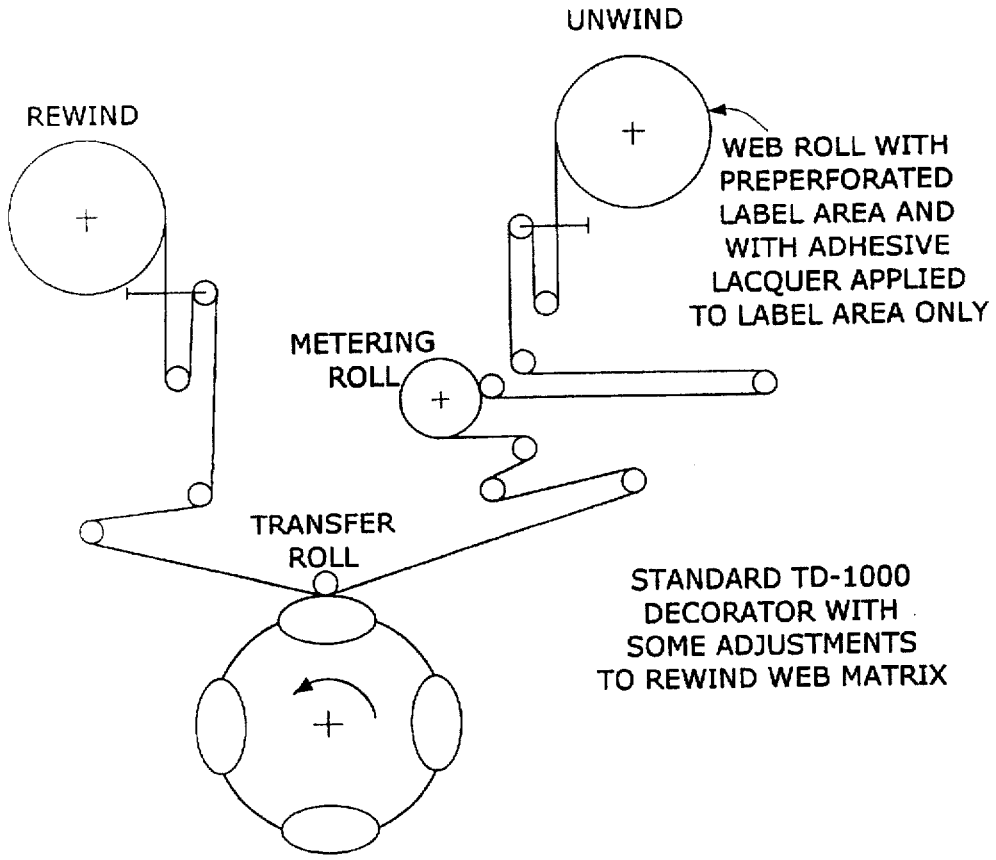
FIG. 33 is a schematic representation of a decorating machine embodying the principles of the present invention.

FIG. 33 shows a typical heat-transferred decorating system such as the product manufactured by Avery Dennison Corp. and sold under the trademark TD-1000. The web and labels embodying the principles of the present invention would be provided on the unwind reel and would be fed through the web path. The matrix (the part of the web which is not a label) which remains after decoration would be rewound on the rewind reel.

Figure 34:
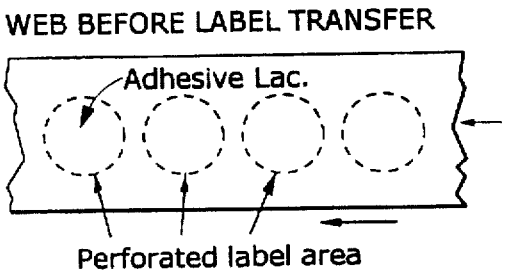
FIG. 34 is a schematic representation of a web embodying the principles of the present invention.

FIG. 34 shows the web with the labels as perforated zones on the web. This view shows the web prior to the decoration of an article.

Figure 35:
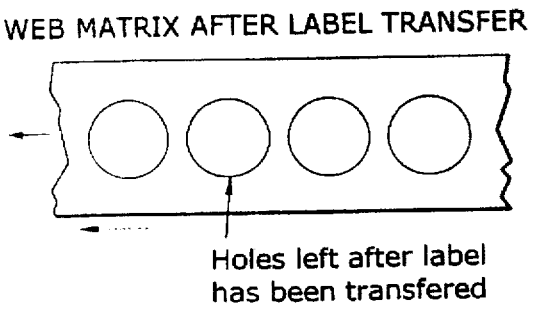
FIG. 35 is a schematic representation of a web embodying the principles of the present invention.

FIG. 35 shows the web after decoration in which the individual labels have been punched out of the web, applied to the decorated article, and the remaining web matrix is fed back to the rewind reel.

Figure 36:
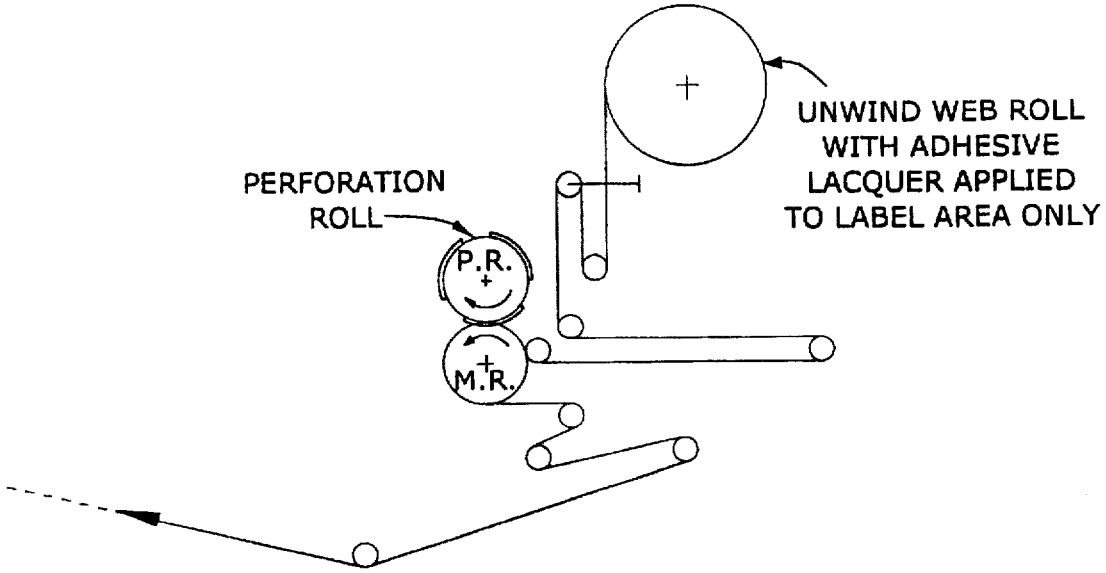
FIG. 36 is a schematic representation of a decorating machine embodying the principles of the present invention.

FIG. 36 shows a modification of this approach in which the individual label zones on the web are provided with adhesive but are not pre-perforated. The decorating equipment would include a perforating roll which acts against the standard metering roll to perforate the zones around the labels.

Figure 37:
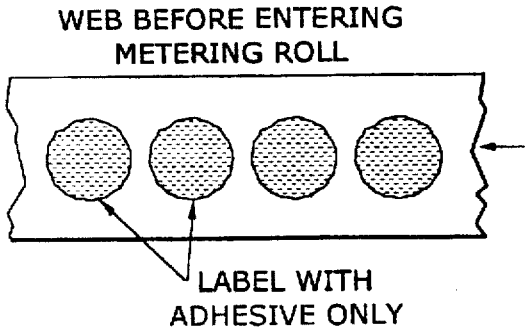
FIG. 37 is a schematic representation of a web embodying the principles of the present invention.

FIG. 37 shows the web with the adhesive zones but prior to perforation.

Figure 38:
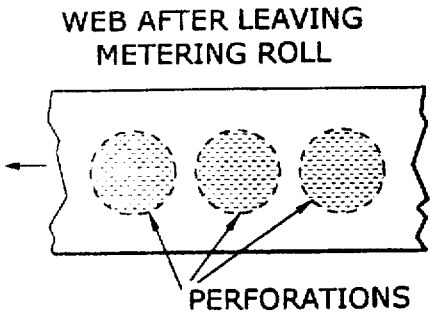
FIG. 38 is a schematic representation of a web embodying the principles of the present invention.

FIG. 38 shows the web after perforation but prior to decoration. The matrix after decoration would look the same as in FIG. 35.

Figure 39:
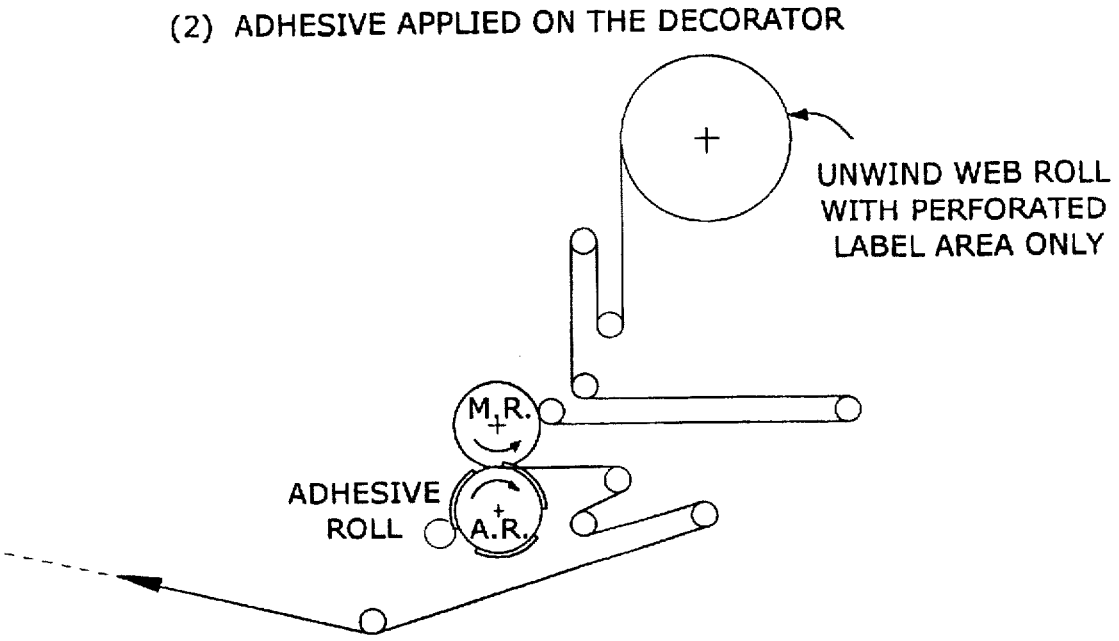
FIG. 39 is a schematic representation of a decorating machine embodying the principles of the present invention.

FIG. 39 shows another variation of this concept in which the web is pre-perforated but does not have the adhesive lacquer applied prior to unwinding. In this embodiment, the perforated web would be fed around the metering roll and then the adhesive lacquer would be applied using conventional spot-application equipment. Figures showing this embodiment are schematic as the adhesive would normally be applied to the opposite side of the web.

Figure 40:
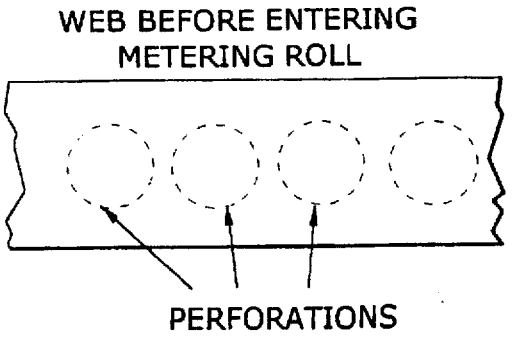
FIG. 40 is a schematic representation of a web embodying the principles of the present invention.

FIG. 40 shows the web with a perforation and prior to the application of the adhesive.

Figure 41:
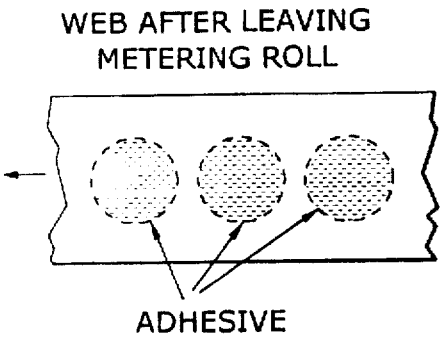
FIG. 41 is a schematic representation of a web embodying the principles of the present invention.

FIG. 41 shows the web with a perforation and after the adhesive has been applied, but before decoration.

After decoration, the matrix would look like the matrix shown in FIG. 35.

FIG. 42 shows an application in which the web is neither perforated nor does it carry the adhesive lacquer prior to unwinding from the storage roll. In this embodiment, both the perforator and the adhesive lacquer applicator would be positioned around the metering roll.

FIG. 43 shows the web coming off of the unwind roll and prior to any perforation or adhesive lacquer application.

FIG. 44 shows the web after it has been perforated and after the adhesive has been applied to the label zones. This is prior to the decoration.

After decoration, the matrix would resemble that shown in FIG. 35.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

I claim:

1. Apparatus for applying heat transfer labels disposed on a web to containers comprising:

a. a turret, said turret continuously rotating in a first direction and having thereon a plurality of decorating stations at which labels can be transferred from said web to said containers, each decorating station including a container holding assembly, b. means for moving said web along a path which passes through at least two of said plurality of decorating stations, said web moving in a second direction at said at least two of said plurality of decorating stations, and c. means for delivering containers to be decorated to said turret and carrying away containers from said turret after decoration, d. said first direction being opposite to said second direction.

2. Apparatus for applying heat transfer labels disposed on a web to round containers comprising:

a. a turret, said turret continuously rotating in a first direction and having thereon a plurality of decorating stations at which labels can be transferred from said web to said containers, each decorating station including a container holding assembly having a rotating cup and a label transfer assembly, b. means for moving said web continuously along a path which passes through at least two of said plurality of decorating stations, said web moving in a second direction at said at least two of said plurality of decorating stations, and c. means for delivering containers to be decorated to said turret and carrying away containers from said turret after decoration, d. said first direction being opposite to said second direction.

3. The apparatus of claim 2 wherein said rotating cups are turning in the same direction as the direction of movement of the web.

* * * * *